United States Patent [19]

Jiruse et al.

[11] Patent Number: 4,786,043

[45] Date of Patent: Nov. 22, 1988

[54] DEVICE FOR FEEDING SINGLE PAPER SHEETS FROM A PILE

[75] Inventors: Jaroslav Jiruse, Blansko; Milan Konecny, Olomoucany; Vladimir Drlik, Bilovice nad Svitavou, all of Czechoslovakia

[73] Assignee: ZVS - Adamovsky strojirny koncernovy podnik Adamov, damov, Czechoslovakia

[21] Appl. No.: 918,170

[22] Filed: Oct. 10, 1986

[51] Int. Cl.[4] ..... B65H 3/08

[52] U.S. Cl. ..... 271/103; 271/105; 271/107

[58] Field of Search ..... 271/93, 98, 91, 11, 271/103, 104, 105, 107, 92, 97, 5

[56] References Cited

U.S. PATENT DOCUMENTS

| | | | |
|---|---|---|---|
| 2,203,823 | 6/1940 | Jirousek | 271/104 |
| 2,722,416 | 11/1955 | Backhouse | 271/103 |
| 3,482,833 | 12/1969 | Schleiden | 271/98 |
| 3,695,606 | 10/1972 | Wirz | 271/93 |
| 3,809,389 | 5/1974 | Wirz | 271/93 X |
| 3,938,800 | 2/1976 | Wirz | 271/93 |

FOREIGN PATENT DOCUMENTS

| | | | |
|---|---|---|---|
| 1235339 | 5/1960 | France | 271/104 |

*Primary Examiner*—Joseph J. Rolla
*Assistant Examiner*—David H. Bollinger
*Attorney, Agent, or Firm*—Klein & Vibber

[57] ABSTRACT

Feeding device for feeding paper sheets from a pile, particularly in offset printing machines. The device has a driving mechanism, the operation of which is controlled by three sets of two cams in precise intervals according to the program of operation of the printing machine. All control mechanisms have their operation motions designed separately in such manner, that each mechanism is controlled by one set of two cams. The advantage of the said feeding device consists in that the control mechanism perform precise operations in accordance with the program of operation even at high printing speeds, because they are controlled bilaterally by the set of two cams and double rollers without employing spring elements to cause cam followers to remain in contact with cam surfaces.

3 Claims, 2 Drawing Sheets

DEVICE FOR FEEDING SINGLE PAPER SHEETS FROM A PILE

BACKGROUND OF THE INVENTION

The present invention relates to a feeding device for feeding single paper sheets from a stack, for example, in offset printing machines.

The purpose of the present invention is to provide a driving mechanism for the feeding device, of which the motion is controlled by sets of two cams within precise intervals, according to the need of a program of the operation, while all control mechanisms derive their operative motions separately in such manner that each mechanism is controlled by one set of two cams.

Feeding devices are known, in which the drive of the control mechanism for sheet moving suckers and the calliper is derived from cams in cooperation with resilient elements. (See for example U.S. Pat. Nos. 3,938,800 and 3,695,606).

The disadvantage of this feeding device consists in that, at higher printing speeds, the rollers of the control mechanisms do not follow the shape of the control cams, whereby inaccuracies in control operations result.

Another known feeding device (see for example Czechoslovakian Authorship Certificate No. 180,466) is arranged in such manner, that the motions of the controlled mechanisms are derived from one drum cam. The mechanism for controlling the sheet moving suckers is controlled by one bilateral cam path and a stationary, vertically mounted frame with a shaped groove. The mechanism of the sheet end hold-down calliper is controlled by a unilateral path of the drum cam and a resilient element.

The disadvantage of the last mentioned device consists in that the said drive is suitable for only simple universal suckers, which are intended for both lifting paper sheets and transporting them. This device cannot be used for separately operating sucker systems, wherein one sucker system lifts the papers sheets, and another sucker system feeds them into the printing machine.

A further disadvantage of such device consists in that the resilient elements for conrolling the calliper cause an inaccurate operation thereof.

SUMMARY OF THE INVENTION

The above-mentioned disadvantages of the prior are mitigated by the feeding device according to the present invention. In the device of the invention on the driving shaft, which is mounted in the body of the feeding device, a two-armed or bifurcated lever is arranged, which is provided with a pair of first rollers on the respective arms bearing against the surfaces of the first set of cams, and further a control fork, which is provided with a pair of second rollers bearing against the cam surfaces of a second set of cams, and still further a bifurcated lever provided with a pair of third rollers which bear against the surfaces of a third set of cams. Connecting rods are swingably fastened on one end in the fork-shaped arms of the bifurcated lever, such rods being fastened at their other ends on a supporting tube provided with feeding suckers. In the control fork, a supporting tube is mounted, which is provided with front forwarding suckers, and which is firmly connected with a sucker bar, on which the rear forwarding sucker is arranged, while on the sucker bar there is fastened a guiding roller. The guiding roller is located in the guide fastened to the body of the feeding device. In the fork-shaped part at the end of the lever arm, a crosshead pin, which is provided with a through-hole, is turnably fastened; one end of the tie rod provided with a spring is mounted in said throughhole while in the lower end of the tie rod, a calliper and a swinging fork are fastened by means of a pin, the swinging fork being swingably mounted with its other end on a pin mounted in the body of the feeding device. At the end of its tie rod, a square nut is fixed, the square nut being located in the fork-shaped part of the lever. The aforementioned spring bears at one end against the crosshead pin, and at the other end bears against a step on the tie rod.

The advantage of the above-mentioned feeding device consists in that the control mechanisms perform their operations precisely in accordance with the program of the operation, even at high printing speeds, since they are controlled bilaterally by sets of two cams and roller pairs without using resilient elements. A further advantage of the said device consists in that the spring mounting of the sheet end engaging calliper operates only within the range of the travel difference of the feed table of the offset printing mechanism, while the actual calliper operating mechanism has no resilient elements. A further advantage of the said feeding device consists in that it controls both sucker systems, i.e. the feeding suckers and the forwarding suckers independently within precise intervals which are prescribed by cams, of which the directrices (cam surfaces) are in accordance with the program of operation of the feeding device.

BRIEF DESCRIPTION OF THE DRAWING

A further embodiment of the feeding device of the invention is shown in the accompanying drawings, in which.

DETAILED DESCRIPTION

Figure 3:
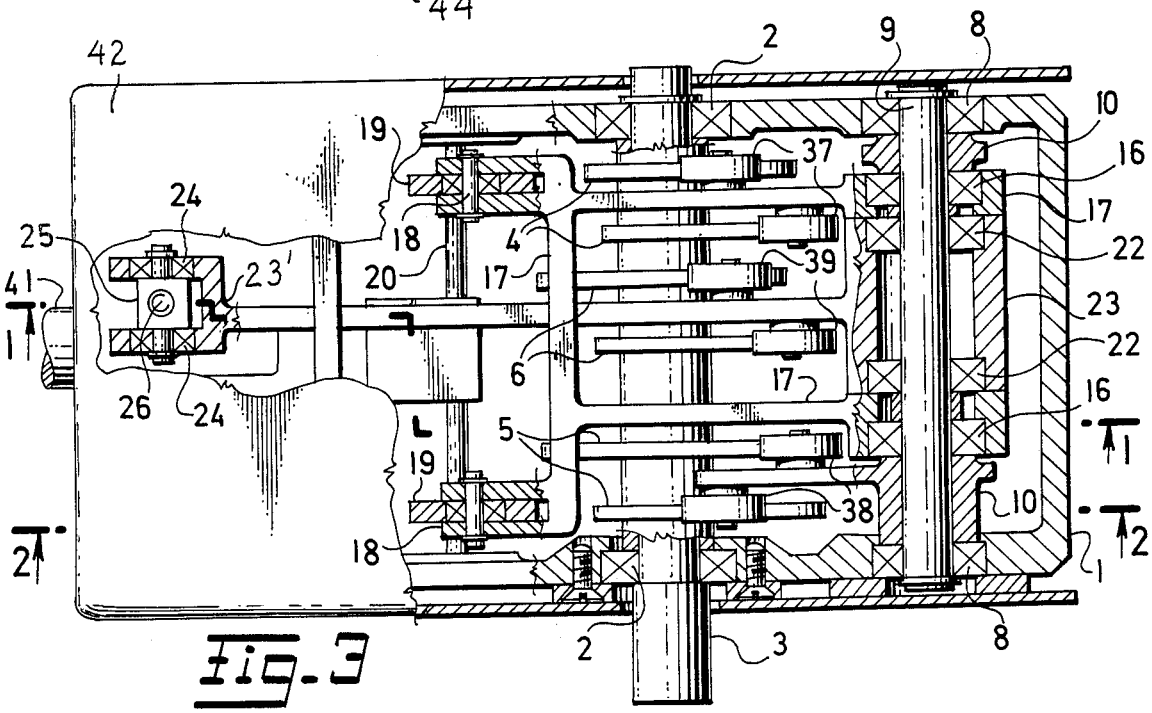
FIG. 3 is a view partially in plan and partially in horizontal section through the feeding device.

The illustrated feeding device according to the present invention consists of a U-shaped body 1, in which a driving shaft 3 is mounted by means of bearing 2 (FIG. 3). On the driving shaft 3 there is mounted a first set of two cams 4 (FIG. 3) for the control of feeding sucker 21, a second set of two cams 5 for the control of the sheet forwarding suckers 12, 13 and a third set of two cams 6 for the control of a calliper 7. In the body 1 of the feeding device, a supporting pin 9 is mounted in bearings 8; on pin 9 by means of bearings 16 (FIG. 3) a double lever 17 is mounted, the left-hand end of the arms of which are fork-shaped. Furthermore, on the supporting pin 9, a control fork 10 is mounted and, by means of bearings 22, a lever 23 is swingably mounted on pin 9, one arm 23' of lever 23 being fork-shaped at its left-hand end.

Figure 1:
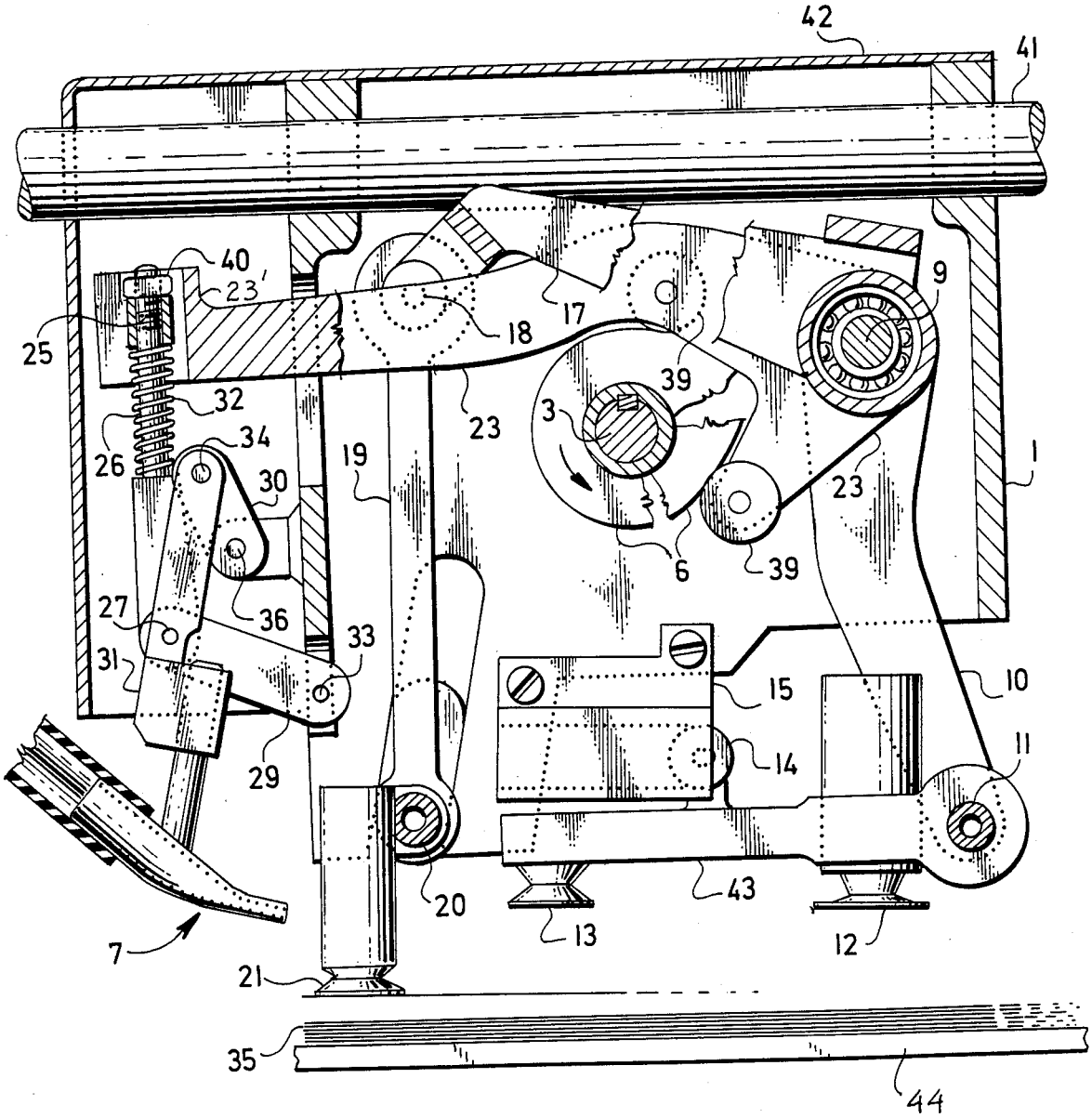
FIG. 1 is a view partially in front elevation and partially in vertical section of the feeding device in the position of the parts thereof which they occupied upon the lifting of the calliper, the section being taken along the broken section line 1—1 in FIG. 3.

The double lever 17 is provided with a pair of first rollers 37 (FIG. 3) of which each bears against the respective cam surface of the first set of two cams 4. The control fork 10 is provided with a pair of second rollers 38 (FIG. 2) of which each bears against the respective cam surface of the second set of cams 5. Lever 23 (FIG. 1) is provided with a pair of third rollers 39, of which each bears against a respective cam surfaces of the third set of two cams 6. The circumferential curves of the first cam 4, the second cam 5, and the third cam 6 are in accordance with the program of operation of the whole feeding device.

In lower ends of the arms of the control fork 10, a supporting tube 11 is mounted on which front (right) sheet forwarding suckers 12 are arranged, and by means of sucker-bar 43, one rear sheet forwarding sucker 13 is fastened. The position of the forwarding suckers 12 and 13 determined by the location of a guiding roller 14 on bar 43, the roller traveling in a guide 15 secured to the body 1. In the fork-shaped end of the double lever 17 the connecting rods 19 are fastened by means of pins 18 (FIG. 3). In lower part of connecting rod 19, a supporting tube 20 is fastened, on which feeding rear (left) suckers 21 are arranged. In the fork-shaped end 23' of lever 23, a crosshead pin 25 is mounted in bearings 24; in the center of pin 25, a through-hole is made. Inside the hole of the crosshead pin 25, a tie rod 26 is displaceably mounted, the lower end of which is fastened by means of pin 27 to a holder 31 of calliper 7.

On the upper cylindrical part of the rod 26, a coil compression springs 32 is mounted, which bears with one end against the step of crosshead pin 25, and at its other end bears against the step of tie rod 26. The rod 26 is provided at a separate end with square nut 40, which is secured against turning by being placed against the arms of fork-shaped part 23' of lever 23. On the holder 31 of calliper 7, a swinging fork 29 is fastened with one end, while its other end is fastened by means of a pin 33 to the body 1 of the feeding device. On the extended upper part of the holder 31, a swing arm 30 is fastened at one end by means of a connecting pin 34, which is suspended by the intermediary of a pin 36 on body 1 of the feeding device 1.

Figure 2:
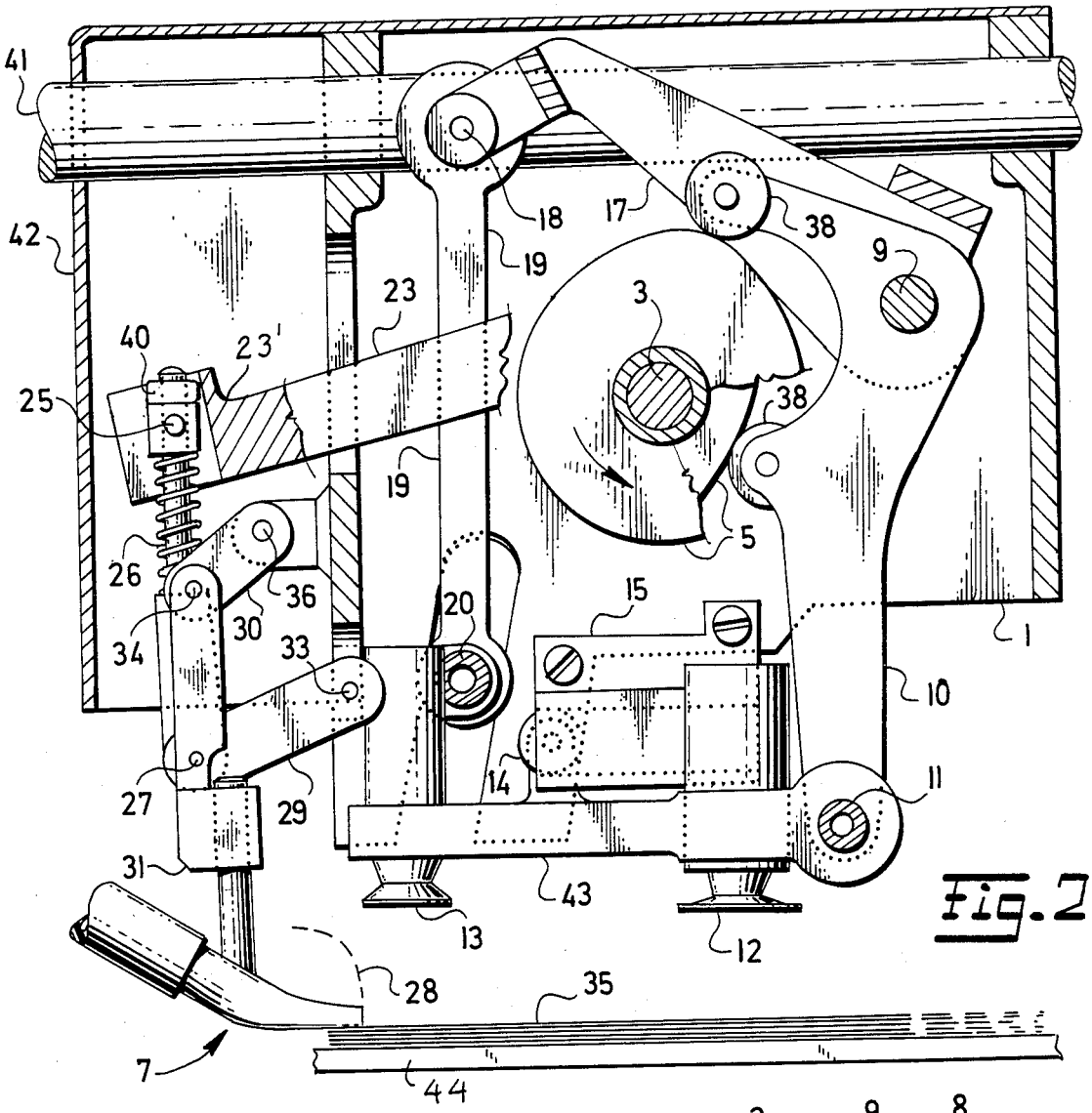
FIG. 2 is a view partially in front elevation and partially in vertical section through the feeding device with the parts thereof in the positions which they occupy upon contact of the calliper with a stack of paper, the section being taken along the line 2—2 in FIG. 3.

The shoe of calliper 7 bears against the pile 35 of sheets on feeding table 44, while the front edge of calliper 7 moves about a curved path 28 (FIG. 2). The body 1 of the feeding device is adjustably fastened to a beam 41, which is fastened to the side wall of the printer (not shown). The mechanism of the feeding device is protected by cover 42, which is fixed on the body 1 of the feeding device.

The above-described feeding device operates as follows:

Upon rotation of driving shaft 3, cams 4, 5, 6, secured thereto also rotate. By rotation of the first cams 4, the rotary motion is transmitted via the first rollers 37 to the double lever 17, from which it is transmitted via connecting rods 19, and supporting tube 20 to the sheet feeding suckers 21. By the rotation of the second cams 5, swinging motion is transmitted, via the second rollers 38 and the control fork 10, to supporting tube 11 and the sheet forwarding suckers 12 and 13. By the rotation of the third cams 6, the swinging motion is transmitted via the third rollers 38 to the lever 23, which controls the calliper 7 via tie rod 26. The feeding suckers 21 remove from sheet pile 35 on table 44, by means of underpressure, the separate sheets and lift them to the level of the forwarding suckers 12, 13, which, by means of underpressure, take over the separate sheets and transport them into a transporting device (not shown).

The whole operation cycle takes place in such manner, that the feeding suckers 21 lift the sheet into the upper position, where upon the calliper 7 bears against the pile of sheets 35 by positive motion, which is derived from the third cams 6, and the front edge of the shoe of calliper 7 describes a motion along the curved path 28. Upon the bearing of calliper 7 against sheet pile 35, motion of lever 23 continues and the crosshead pin 25 compresses spring 32. The compression of spring 32 occurs only within the range of the difference of level of the feed table, on which the pile 35 of paper sheets is located. Spring 32 secures only an elastic contact of calliper 7 with the sheet pile 35, while the return motion of the calliper 7 into its upper position is again positively controlled by the third cams 6.

Although the invention is described and illustrated with reference to a single embodiments thereof, it is to be expressly understood that it is in no way limited to the disclosure of such preferred embodiment but is capable of numerous modifications within the scope of the appended claims.

We claim:

1. A feeding device for feeding paper sheets from a pile, these sheets being fed from a pile of sheets by means of pneumatic suckers which are operatively mounted in said device, comprising a driving shaft which is operatively mounted in the feeding device, first, second and third sets of pairs of cams fastened on the driving shaft, a supporting shaft mounted in said feeding device, a double lever provided with a first pair of rollers is pivotally mounted on said supporting shaft, the first rollers bearing against the surfaces of the first set of a pair of cams, a control fork provided with a pair of second rollers is pivotally mounted on said supporting shaft, said second rollers bearing against the surfaces of the second set of a pair of cams, a lever provided with a pair of third rollers is pivotally mounted on said supporting shaft, said lever having a pair of arms at the free ends of which said third rollers bearing against the surfaces of the third set of a pair of cams; there is operatively mounted a supporting tube member at one free end of said control fork, a sucker bar mounted on the support tube member, and front forwarding sucker means mounted upon the sucker bar, a guiding roller mounted on the sucker bar, said guiding roller reciprocally travels in a guide fastened to the feeding device.

2. A feeding device as claimed in claim 1, wherein the free end of one arm of the lever has a fork-shaped part, a crosshead pin provided with a through-hole being fastened to said end of the lever, a tie rod having two ends, one end of the tie rod being provided with a coil compression spring mounted between the cross head pin and the other end of the tie rod.

3. A feeding device as claimed in claim 2, wherein there is fixedly mounted a square nut at the upper end of the tie rod, said nut being mounted in the fork-shaped part of the lever, the coil compression spring bearing at one end against the crosshead pin, and the other end, bearing against a step on the tie rod.

* * * * *